US006305747B1

(12) United States Patent
Mei

(10) Patent No.: US 6,305,747 B1
(45) Date of Patent: Oct. 23, 2001

(54) SWAYABLE BACKREST ASSEMBLY FOR A CHAIR

(76) Inventor: Teng-Fu Mei, P.O. Box 63-247, Taichung (TW)

( * ) Notice: Subject to any disclaimer, the term of this patent is extended or adjusted under 35 U.S.C. 154(b) by 0 days.

(21) Appl. No.: 09/586,647

(22) Filed: Jun. 5, 2000

(51) Int. Cl.[7] ..... A47C 1/024
(52) U.S. Cl. ..... 297/354.11; 297/440.2
(58) Field of Search ..... 297/354.1, 354.11, 297/440.2

(56) References Cited

U.S. PATENT DOCUMENTS 1,357,826 * 11/1920 Shaw ..... 297/354.11
1,910,760 * 5/1933 Garrow ..... 297/354.11
2,345,926 * 4/1944 Fields et al. ..... 297/354.11
2,703,601 * 3/1955 Wood ..... 297/354.11

* cited by examiner

*Primary Examiner*—Anthony D. Barfield
(74) *Attorney, Agent, or Firm*—Alan Kamrath; Rider, Bennett, Egan & Arundel, LLP

(57) ABSTRACT

A swayable backrest includes a backrest frame including two spaced vertical tubes each having a lower end attached to the seat of the chair. Each vertical tube further includes an upper end with a first hole. A hollow connecting beam is connected between the upper ends of the two vertical tubes and includes two transverse slots. An attaching member includes two ends each having a second hole. Each end of the attaching member is extended through an associated transverse slot. The attaching member is attached to a backrest of the chair to move therewith. A pivotal tube extends through the first hole of each said vertical tube, the second hole of each end of the attaching member, and the hollow connecting beam, thereby allowing pivotal movement of the attaching member relative to the backrest frame.

3 Claims, 5 Drawing Sheets

SWAYABLE BACKREST ASSEMBLY FOR A CHAIR

BACKGROUND OF THE INVENTION

1. Field of the Invention

The present invention relates to a swayable backrest assembly for a chair.

2. Description of the Related Art

Modern people spend considerable time in sitting. A chair with a swayable backrest may provide the user with comfortable feeling. The present invention is intended to provide a swayable backrest assembly to meet this end.

SUMMARY OF THE INVENTION

In accordance with the present invention, a swayable backrest is provided for a chair with a seat. The swayable backrest comprises:

a backrest frame comprising two spaced vertical tubes each having a lower end attached to the seat of the chair, each said vertical tube further including an upper end with a first hole;

a hollow connecting beam being connected between the upper ends of the two vertical tubes, the hollow connecting beam including two transverse slots;

an attaching member including two ends each having a second hole, each said end of the attaching member being extended through an associated said transverse slot, the attaching member being attached to a backrest of the chair to move therewith;

a pivotal tube extending through the first hole of each said vertical tube, the second hole of each said end of the attaching member, and the hollow connecting beam, thereby allowing pivotal movement of the attaching member relative to the backrest frame.

Other objects, advantages, and novel features of the invention will become more apparent from the following detailed description when taken in conjunction with the accompanying drawings.

DETAILED DESCRIPTION OF THE INVENTION

Figure 1:
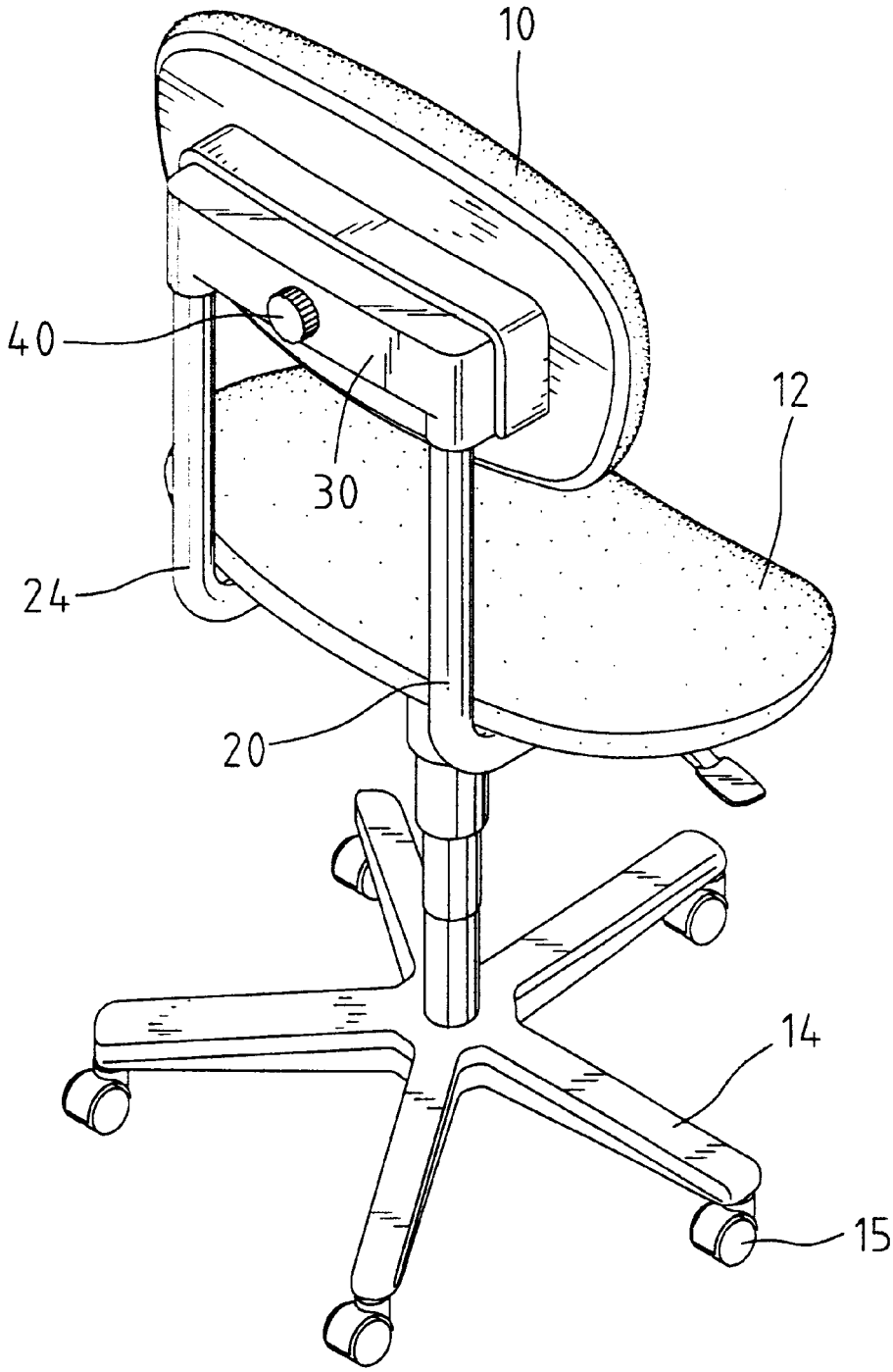
FIG. 1 is a perspective view of a chair with a swayable backrest assembly in accordance with the present invention.
Figure 2:
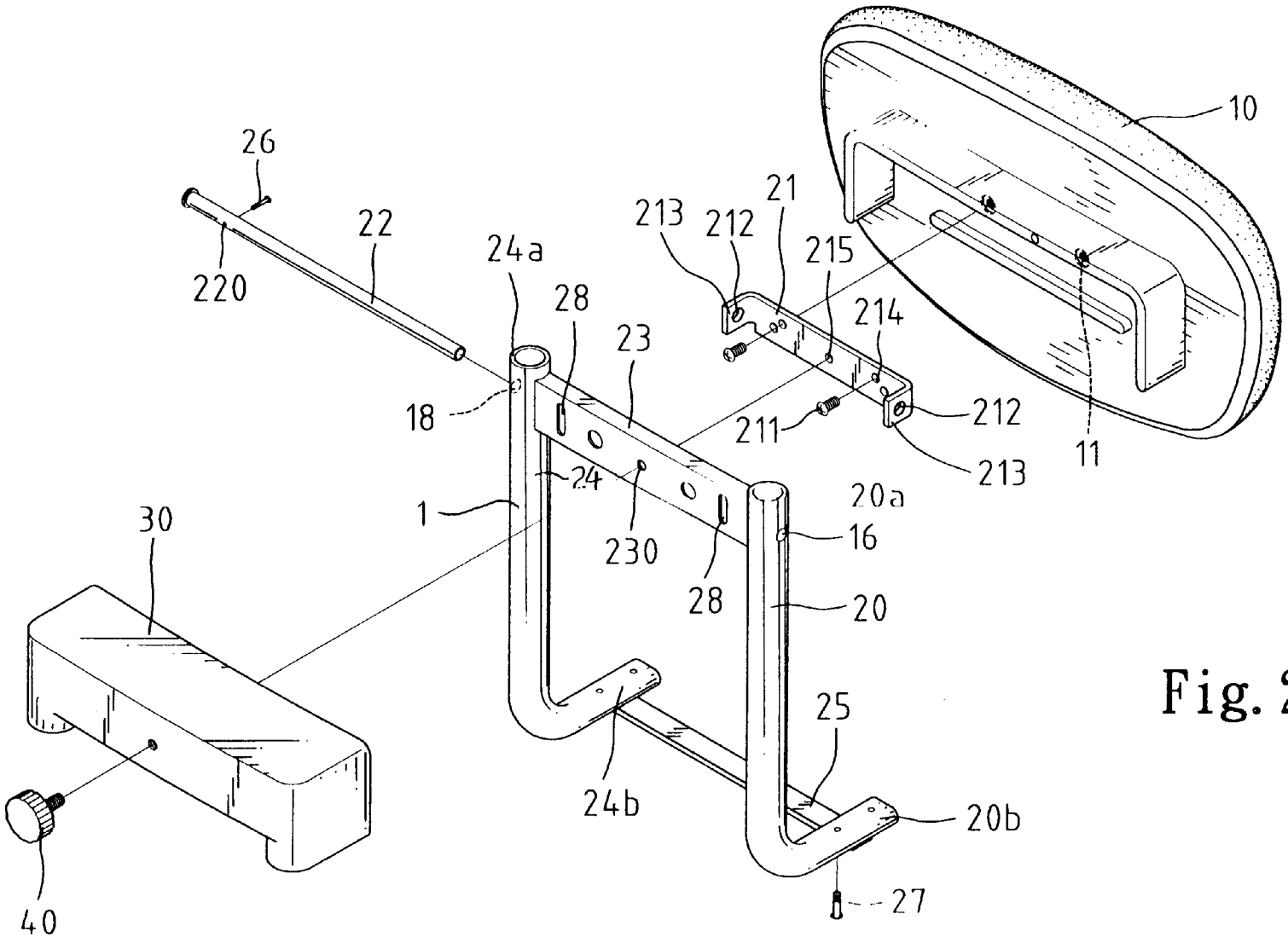
FIG. 2 is an exploded perspective view of the swayable backrest assembly in accordance with the present invention.

Referring to FIGS. 1 and 2, a chair generally includes a base 14 in the form having a plurality of legs each having a caster 15 mounted to an underside thereof. A seat 12 is mounted on top of the base 14, and a backrest assembly is attached to the seat 12.

The backrest assembly in accordance with the present invention includes a backrest frame 1 having two vertical tubes 20 and 24 and a hollow connecting beam 23 connected between upper ends 20*a* and 24*a* of the tubes 20 and 24. A reinforcing beam 25 is mounted between horizontal lower ends 20*b* and 24*b* of the tubes 20 and 24. Fasteners 27 are provided to attach the backrest frame 1 to the seat 12. The upper end 20*a*, 24*a* of each vertical tube 20, 24 includes a hole 16, 18 that is in alignment with longitudinal hollow interior of the connecting beam 23.

Figure 3:
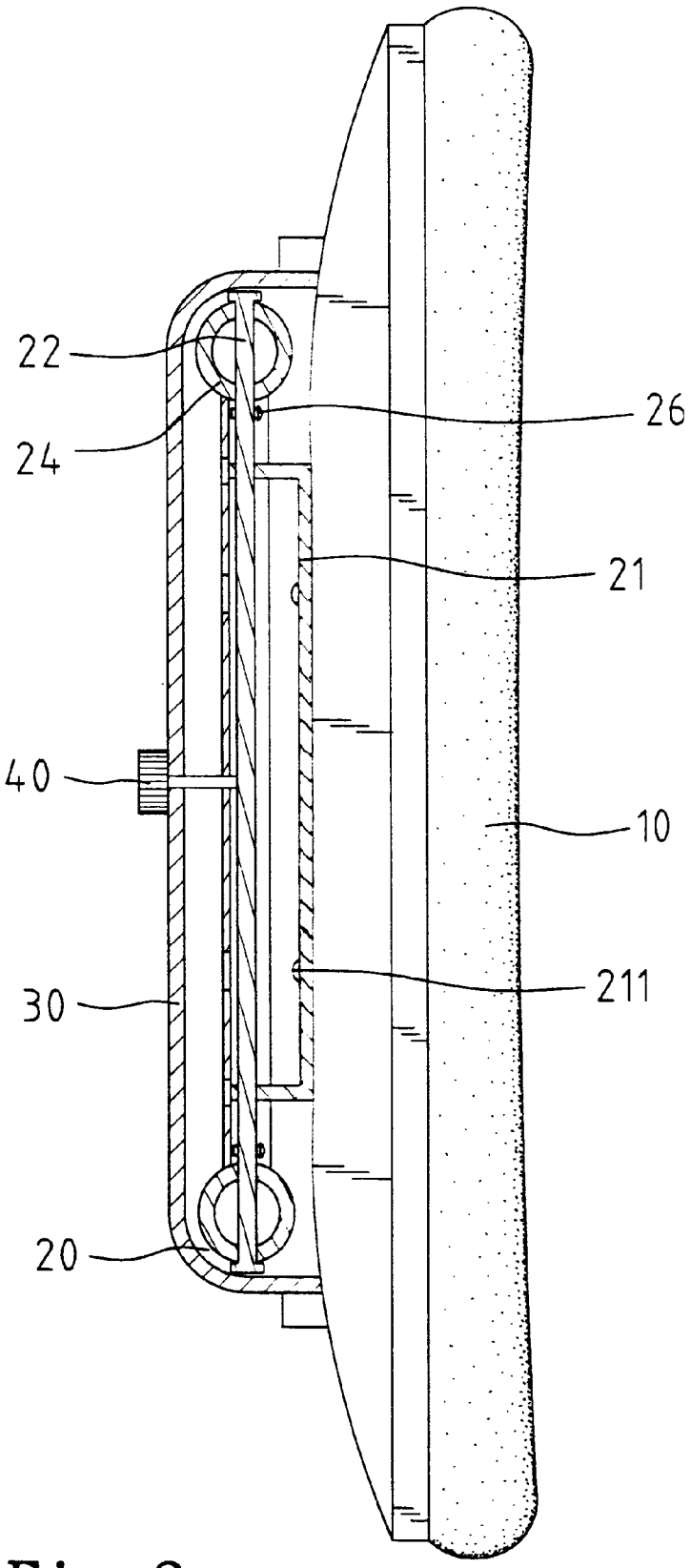
FIG. 3 is a top view, partly sectioned, of the swayable backrest assembly in accordance with the present invention.

The hollow connecting beam 23 is substantially U-shape and includes two transverse slots 28. A substantially U-shape attaching member 21 includes two ends 213 that are extended through the transverse slots 28 of the hollow connecting beam 23, respectively, each end 213 having a hole 212. As illustrated in FIGS. 2 and 3, a pivotal rod or tube 22 is extended through the hole 18 of the vertical tube 24, the hollow connecting beam 23, the holes 213 of the attaching member 21, and the hole 16 of the other vertical tube 20, thereby allowing pivotal movement of the attaching member 21 relative to the backrest frame 1. A screw 26 is extended through a transverse hole 220 in the pivotal tube 22 to prevent disengagement of the pivotal tube 22 after the pivotal tube 22 is mounted to the backrest frame 1, best shown in FIG. 3. A backrest 10 is attached to the attaching member 21 by means of extending screws 211 through holes 214 in the attaching member 21 and screw holes 11 in the backrest 10. For aesthetically pleasing purpose, a cover 30 is provided to enclose upper end of the backrest frame 1 and corresponding elements. A fastener 40 is extended through the cover 30, a hole 230 in the hollow connecting beam 23, and a hole 215 in the attaching member 21.

Figure 4:
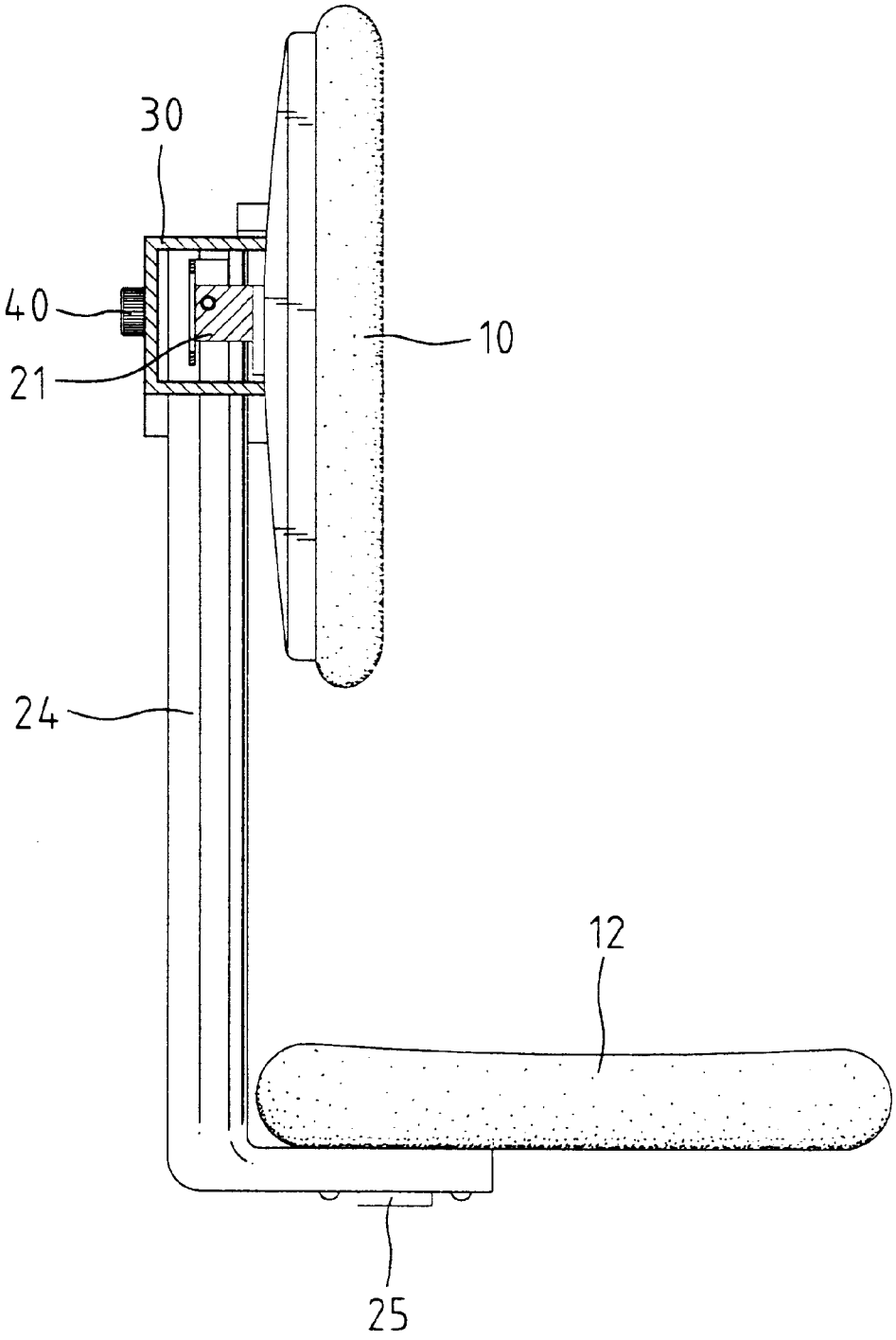
FIG. 4 is a side view, partly sectioned, of the swayable backrest assembly and a seat.
Figure 5:
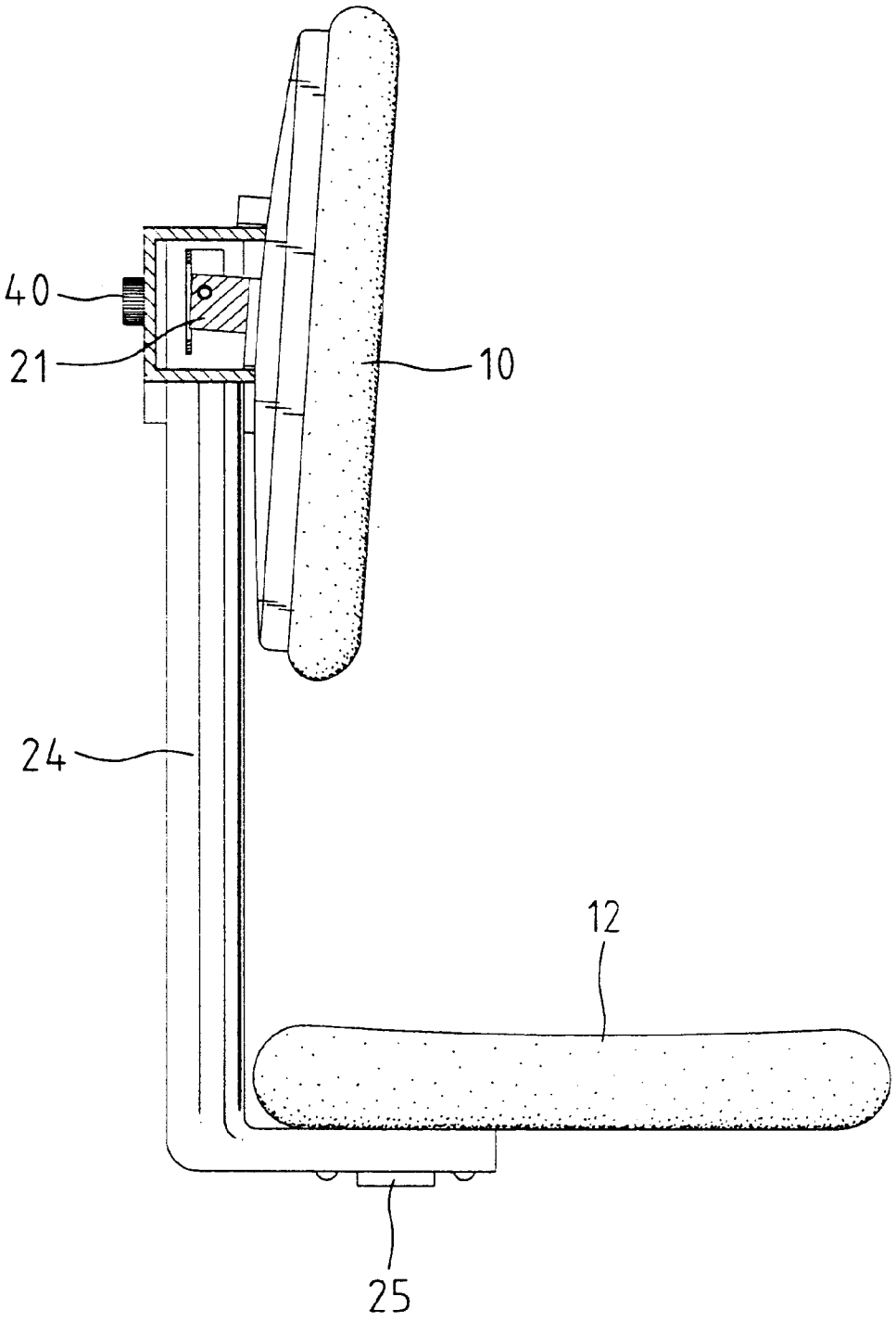
FIG. 5 is a partly sectioned side view similar to FIG. 4, illustrating swaying movement of the backrest.

The backrest frame 1 so constructed allows swaying movement of the backrest 10 relative to the backrest frame 1. Pivotal (swaying) movement of the backrest 10 is shown in FIGS. 4 and 5. Thus, the swayable backrest 10 may provide a comfortable feeling during use. As illustrated in FIG. 2, the U-shape hollow connecting beam 23 includes an open side 230 that faces the backrest 10, thereby allowing pivotal movement of the attaching member 21.

Although the invention has been explained in relation to its preferred embodiment, it is to be understood that many other possible modifications and variations can be made without departing from the spirit and scope of the invention as hereinafter claimed.

What is claimed is:

1. A swayable backrest for a chair with a seat, comprising:

a backrest frame comprising two spaced vertical tubes each having a lower end attached to the seat of the chair, each said vertical tube further including an upper end with a first hole;

a hollow connecting beam being connected between the upper ends of the two vertical tubes, the hollow connecting beam including two transverse slots;

an attaching member including two ends each having a second hole, each said end of the attaching member being extended through an associated said transverse slot, the attaching member being attached to a backrest of the chair to move therewith;

a pivotal tube extending through the first hole of each said vertical tube, the second hole of each said end of the attaching member, and the hollow connecting beam, thereby allowing pivotal movement of the attaching member relative to the backrest frame.

2. The backrest assembly as claimed in claim 1, further comprising a cover for enclosing an upper end of the backrest frame.

3. The backrest assembly as claimed in claim 1, wherein the hollow connecting beam is U-shape with an open side facing the backrest.

* * * * *